US005452534A

United States Patent [19]

Lambie

[11] Patent Number: 5,452,534

[45] Date of Patent: Sep. 26, 1995

[54] RECEIVER FOR FIREARM

[76] Inventor: Michael G. Lambie, 6685 Lake Rd. R.D. 2, Pulaski, N.Y. 13142

[21] Appl. No.: 289,906

[22] Filed: Aug. 12, 1994

[51] Int. Cl.[6] ..... F41A 9/71

[52] U.S. Cl. ..... 42/18

[58] Field of Search ..... 42/18, 22, 50, 42/6

[56] References Cited

U.S. PATENT DOCUMENTS

| | | | |
|---|---|---|---|
| 894,530 | 7/1908 | Punches | 42/22 |
| 1,074,948 | 10/1913 | Hiscock | 42/18 |
| 1,407,633 | 2/1922 | Burton | 42/50 |
| 2,296,729 | 9/1942 | Mossberg | 42/50 |
| 2,895,248 | 7/1957 | Sawin | 42/18 |
| 2,910,795 | 11/1959 | Agren | 42/18 |
| 3,190,023 | 6/1965 | Reed | 42/18 |
| 3,771,415 | 11/1973 | Into et al. | 42/16 |
| 4,016,667 | 4/1977 | Forbes | 42/18 |
| 4,139,958 | 2/1979 | Foote | 42/49.02 |
| 4,226,041 | 10/1980 | Goodworth | 42/18 |
| 5,253,442 | 10/1993 | Kim | 42/50 |

*Primary Examiner*—Charles T. Jordan

*Attorney, Agent, or Firm*—Harris Beach & Wilcox

[57] ABSTRACT

A semi-automatic weapon having a magazine well in the receiver section thereof. The well has opposed side walls and end walls to describe a box like enclosure for receiving a cartridge magazine. A bottom wall is also provided which guides the magazine vertically into the well. An opening is formed in one of the side walls that has a geometry that limits the size and shape and thus the capacity of a magazine that can be inserted through the opening into the well.

7 Claims, 3 Drawing Sheets

RECEIVER FOR FIREARM

BACKGROUND OF THE INVENTION

This invention relates to apparatus for limiting the number of cartridges that can be magazine loaded into a semi-automatic weapon.

Semi-automatic firearms capable of firing a large number of rounds in a short period of time are readily available at affordable prices to the general public. Misuse of these rapid fire weapons, however, is of growing concern, particularly among law enforcement people. Most semi-automatic weapons can accept magazines holding twenty or more rounds, thus providing law breakers or the like with unprecedented firepower.

Most semi-automatic weapons are sold to sportsmen for hunting or target shooting purposes. The average sportsman, however, rarely needs a magazine holding more than five cartridges and thus has little, if any, use for an oversized magazine. No one to date, however, has attempted to limit the size or capacity of magazines that can be inserted into the receiver of these potentially dangerous weapons.

SUMMARY OF THE INVENTION

It is therefore an object of the present invention to limit the size and capacity of magazines that can be loaded into a semi-automatic weapon.

It is a further object of the present invention to limit the firepower of a semi-automatic weapon.

A still further object of the present invention is to limit the firepower of a semi-automatic weapon without adversely effecting the operation of the weapon.

Yet another object of the present invention is to provide an apparatus that can be easily installed in an automatic weapon that will limit the number of cartridges that can be stored in the receiver of the weapon.

These and other objects of the present invention are attained in a semi-automatic firearm that includes a receiver having a magazine well, a barrel adjacent to the receiver and a chamber in the barrel into which cartridges are fed one at a time. The magazine well contains opposed side walls and end walls and a bottom wall that prevents the magazine from being inserted vertically into the well. A side opening is formed in the lower part of one side wall adjacent to the bottom wall through which a magazine can be inserted laterally into the well. The size of the side wall opening is restricted, thus limiting the size of the magazine that is acceptable into the well. Preferably, the size and thus the capacity of the magazine is limited to five cartridges. Access slots are provided in the walls of the magazine well to facilitate vertical movement of a magazine in the well to facilitate finger encasement of the magazine whereby the magazine can be moved vertically into and out of a latched position.

BRIEF DESCRIPTION OF THE DRAWINGS

For a better understanding of these and other objects of the present invention, reference will be made to the following detailed description of the invention which is to be read in conjunction with the accompanying drawings, wherein.

DESCRIPTION OF THE INVENTION

Figure 1:
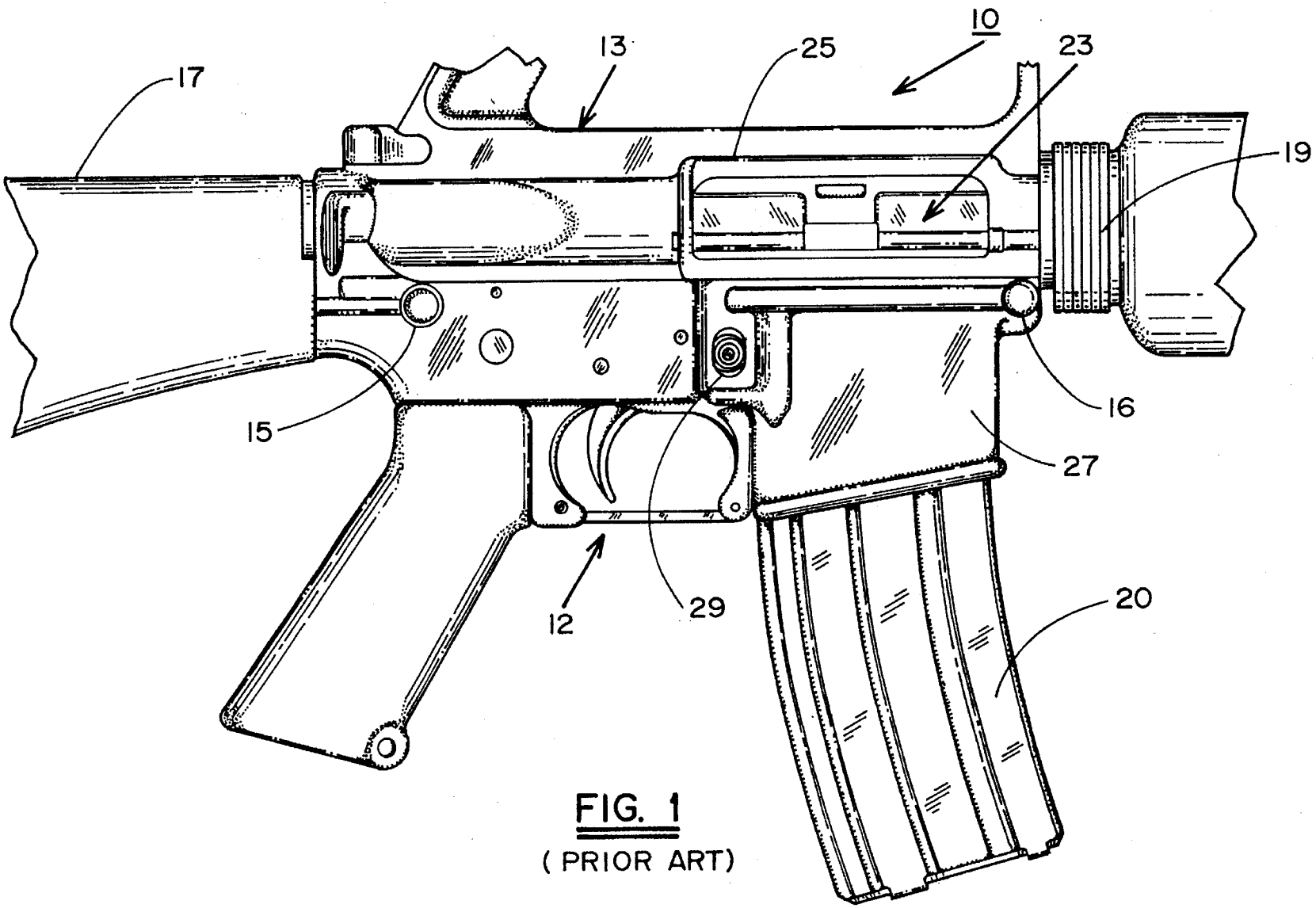
FIG. 1 (PRIOR ART)
FIG. 1 is a partial side elevation of an automatic weapon showing a typical prior art receiver section capable of accepting a high capacity magazine.

Turning now to the drawings, FIG. 1 illustrates a semi-automatic gas operated rifle, generally depicted 10 found in the prior art, that is arranged to fire from a closed bolt position. The rifle includes a lower receiver section 12 that is connected to the upper receiver section 13 by a takedown pin 15 and a hinge pin 16. Pushing out the takedown pin and removal of the hinge pin allows the entire lower receiver section to be removed from the weapon. As will be explained in greater detail below, the lower receiver can thus be easily replaced with a lower receiver embodying the teachings of the present invention without effecting the operation of the weapon.

The rifle further includes a barrel 19 attached to the front of the receiver having a chamber for receiving a cartridge from a magazine 20. The cartridges are fed, as is well known in the art, one at a time from the magazine into the chamber by a bolt mechanism 23. After firing, the bolt is urged back from the firing position to a battery position whereupon the spent cartridge is ejected from the weapon through the ejection port 25. The bolt is then moved forward to slide a fresh cartridge that has moved into a ready position from the magazine into the chamber. A stock 17 is attached to the back of the receiver.

A magazine well 27 is located in the forward part of the lower receiver and is arranged to slidably receive a magazine 20 therein. The magazine is moved upwardly in a vertical direction in the well into a latched position. Although not shown, a latching mechanism is contained within the lower receiver that locks the magazine in the proper cartridge feeding position within the well. Depressing the latch release found on the back side of the lower receiver frees the magazine and permits it to be removed from the weapon.

As can be seen, any capacity magazine can be loaded into the weapon. Magazines holding between twenty and sixty rounds are available for use with most semi-automatic weapons. This, coupled with the fact that semi-automatic weapons can be easily converted to fully automatic operation, provides the possessor of such a weapon with fire power that is far greater than anything needed by the average sportsman.

Figure 2:
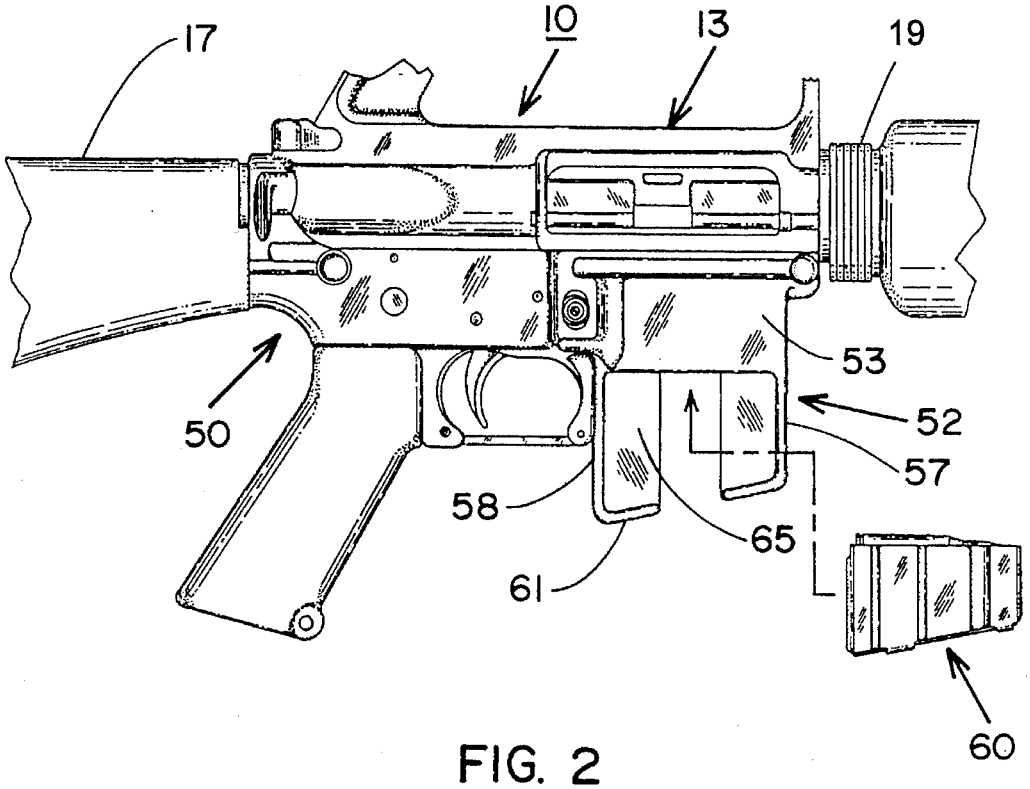
FIG. 2 is a partial front side elevation of an automatic weapon embodying the teachings of the present invention.
Figure 3:
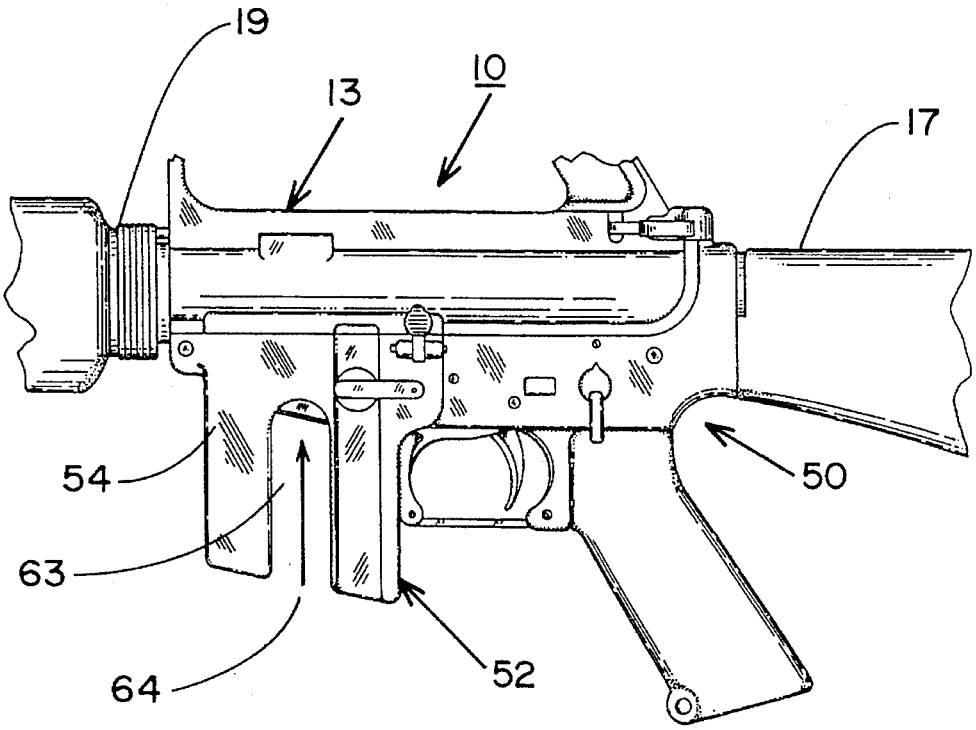
FIG. 3 is a partial back side elevation of the automatic weapon illustrated in FIG. 3.

The apparatus of the present invention will be described with reference to FIGS. 2–4 wherein like numbers are used to identify like parts. As will become apparent from the disclosure below, the present apparatus is designed to limit the number of cartridges that a semi-automatic firearm can hold at any one time. The present design removes the military value of semi-automatic weapons and render these firearms suitable for use for civilian hunting or target shooting market.

As illustrated, the lower receiver of the rifle 10 has been replaced with a new unit 50 that operates in the same manner as that shown in FIG. 1. The magazine well 52 in the new lower receiver unit contains two opposed side walls 53 and 54 and two opposed end walls 57 and 58 that define a rectangular shaped opening (FIG. 2) for slidably receiving a magazine 60 therein. The magazine well further includes a bottom wall 61 that prevents the magazine 60 from being inserted vertically in a single motion into the well. Side wall 54 is provided with an elongated vertically disposed slot 63 that opens into a horizontally disposed slot 64 formed in the bottom wall of the well.

Side wall 53 is foreshortened and cooperates with the bottom wall to establish a side wall opening 65 in the well. The contour of the side wall opening compliments the shape of the magazine 60 and provides sufficient clearance so that the magazine can be inserted laterally into the magazine well along the bottom wall 61. Once inside the well, the magazine can be grasped through the slots and moved upwardly in a vertical direction into the latching mechanism where it is positioned to feed cartridges one at a time into the rifle chamber. The slots formed in the magazine well enable the user ample room to grip the magazine during insertion and removal of the magazine from the weapon.

Figure 4:
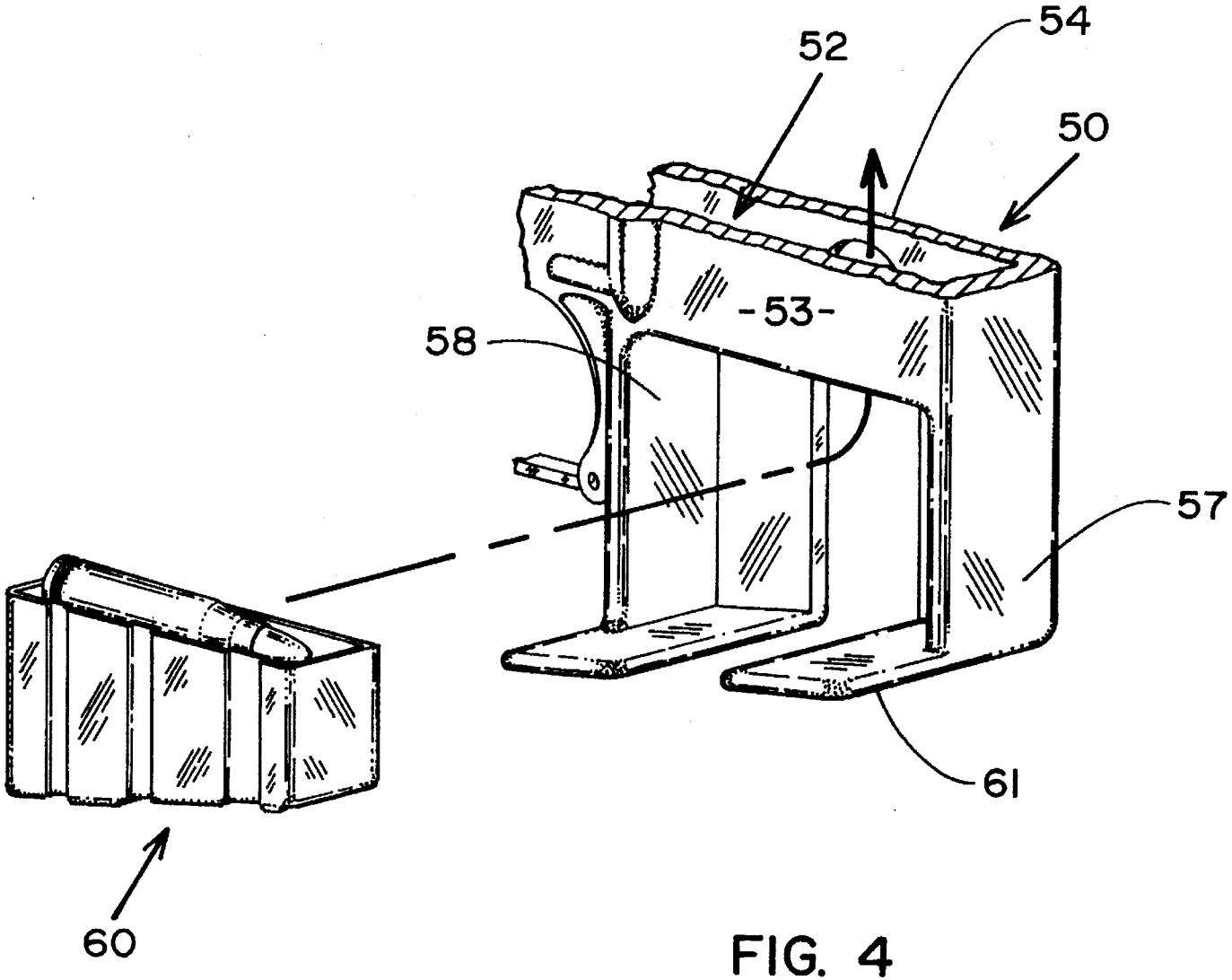
FIG. 4 is an enlarged partial perspective view showing the magazine well employed in the semi-automatic weapon illustrated in FIG. 2.

As best illustrated in FIG. 4, the bottom wall 61 of the magazine well is extended laterally beyond the plane of side wall 53 to provide a platform adjacent to the side wall opening upon which the magazine can be rested prior to insertion into the well. The extended bottom wall guides the magazine into contact against the opposite side wall of the well thus insuring that the magazine is properly seated in the well before it is moved upwardly into the latching mechanism.

The side opening in the well is specifically designed so that only magazines of a limited size and capacity can be moved through the opening into the well. Preferably, the capacity of the magazine is five rounds which will amply satisfy the need of most hunters and target shooters. As can be seen, the present apparatus can be easily retrofitted to most existing firearms or made part of the original equipment without any substantial increase in the cost of the firearm. Any attempt to alter a weapon equipped with this type of a restricted magazine well would also be readily apparent to anyone seeing the altered firearm. Accordingly, if the restricted magazine well is mandated by a law or ordinance, its use could be readily policed by the proper law enforcement agencies.

While this invention has been explained with reference to the structure disclosed herein, it is not confined to the details set forth and this invention is intended to cover any modifications and changes as may come within the scope of the following claims:

What is claimed is:

1. In a semiautomatic firearm having a receiver, a barrel mounted adjacent to the receiver and a chamber in said barrel into which cartridges can be fed one at a time from a magazine located in the receiver, said firearm further including:

a magazine well located in said receiver for slidably guiding a magazine laterally into a first seating position located at the bottom of said well and then upwardly into a second latched position within said receiver whereby cartridges in said magazine are fed one at a time from said magazine into said chamber said magazine well having opposed side walls, end walls, and a bottom wall, one of said side walls having a restricted opening formed in the bottom section thereof adjacent to the bottom wall through which a magazine of limited capacity is insertable laterally into said first position within said magazine well, and said opposing side wall having means for contacting said magazine when in said first position and guiding said magazine upwardly into said second position.

2. The firearm of claim 1 wherein said bottom wall has a first horizontally disposed access slot formed therein to permit a magazine position in said well to be pushed upwardly into a latched position within said receiver.

3. The firearm of claim 2 whereby said opposing side wall has a second vertically disposed access slot formed therein that is aligned with said horizontally disposed access slot formed in the bottom wall to further facilitate insertion and removal of a magazine form said well.

4. The firearm of claim 1 wherein said bottom wall extends laterally beyond said one side wall whereby said bottom wall guides a magazine laterally into said magazine well through said side wall opening.

5. The firearm of claim 1 wherein the end walls and side walls of said well form an unobstructed path through which the magazine can move upwardly from said first position into said second position.

6. The firearm of claim 1 wherein the size of said opening in said one side wall restricts the capacity of the magazine to about five cartridges.

7. The firearm of claim 3 wherein the height of the vertically disposed access slot is greater than the height of said opening in said one side wall to permit a magazine in said second position to be grasped for removal from said well.

* * * * *